United States Patent [19]

Schill et al.

[11] Patent Number: 4,753,571

[45] Date of Patent: Jun. 28, 1988

[54] LIQUEFIED GAS PUMP

[75] Inventors: Jürgen Schill, Weisenheim; Hans-Joachim Franke, Grünstadt, both of Fed. Rep. of Germany

[73] Assignee: Klein, Schanzlin & Becker Aktiengesellschaft, Frankenthal (Pfalz), Fed. Rep. of Germany

[21] Appl. No.: 922,529

[22] Filed: Oct. 24, 1986

[30] Foreign Application Priority Data

Nov. 6, 1985 [DE] Fed. Rep. of Germany ..... 3539251

[51] Int. Cl.[4] ..... F01D 25/32

[52] U.S. Cl. ..... 415/168; 415/176; 415/144; 415/169 A

[58] Field of Search ..... 415/121 A, 144, 168, 415/169 A, 169 R, 199.1, 199.2, 199.3, 199.6, 175, 176; 62/55; 277/15, 22

[56] References Cited

U.S. PATENT DOCUMENTS

| | | | |
|---|---|---|---|
| 3,117,792 | 6/1961 | Glenn et al. | 277/22 |
| 3,370,542 | 2/1968 | Harney | 415/169 |
| 3,733,145 | 5/1973 | Kaplansky | 415/199.1 |
| 4,128,362 | 12/1978 | Shepherd et al. | 415/112 |
| 4,146,238 | 3/1979 | Gaffal | 277/15 |
| 4,390,317 | 6/1983 | Lehmann | 415/199.1 |

FOREIGN PATENT DOCUMENTS

| | | | |
|---|---|---|---|
| 607566 | 10/1957 | Canada | 415/175 |

*Primary Examiner*—Robert E. Garrett
*Assistant Examiner*—Therese Newholm
*Attorney, Agent, or Firm*—Peter K. Kontler

[57] ABSTRACT

A liquefied gas pump wherein a vessel contains a supply of liquefied gas which is pumped from its inlet to its outlet by a multi-stage upright centrifugal pump whose first stage is immersed in the supply of liquefied gas in the vessel. The shaft seal at the upper end of the pump housing is held out of contact with liquefied gas by a first flow restrictor above the last stage of the pump, an expansion chamber which is filled with liquefied gas and is located above the first flow restrictor, a gas collecting chamber between the expansion chamber and the seal, and a second flow restrictor which is disposed between the two chambers and prevents penetration of liquefied gas from the expansion chamber into the collecting chamber. The latter is connected with the vessel and/or with a gas collecting tank. The expansion chamber is connected with the second and/or third stage of the pump in order to ensure that it is filled with liquefied gas.

18 Claims, 3 Drawing Sheets

LIQUEFIED GAS PUMP

BACKGROUND OF THE INVENTION

The invention relates to improvements in liquefied gas pumps, and more particularly to improvements in apparatus for conveying liquefied gases wherein the conveying operation is carried out by one or more multi-stage centrifugal pumps. Still more particularly, the invention relates to improvements in apparatus wherein at least the first stage of the multi-stage centrifugal pump is immersed in a supply of liquefied gas which is confined in a vessel, such as a barrel or a can.

Apparatus of the above outlined character are normally equipped with mechanical seals which operate between the shaft and the housing of the multi-stage pump and are acted upon by a suitable sealing liquid to prevent escape of the conveyed medium along the shaft at that end of the pump housing which is not immersed into the supply of liquefied gas in the vessel. It is also known to provide the housing of a multi-stage pump in an apparatus for conveying liquefied gases with various means, including flow restrictors and chambers, for preventing the penetration of liquefied gas all the way to the shaft seal.

An apparatus which is to convey a liquefied gas must be designed in such a way that it will operate properly even if the pressure of liquefied gas at the inlet of the centrifugal pump merely matches the saturation pressure. However, and since a centrifugal pump will operate properly only if the pressure upstream of the impeller in its first stage exceeds the saturation pressure of the conveyed medium, it is necessary to rely on special undertakings in order to ensure that the pressure of the conveyed medium ahead of the impeller in the first stage of the multi-stage pump will invariably exceed the saturation pressure. This is the reason for placing at least the first stage of the pump into a vessel which contains a supply of liquefied gas and wherein the upper level of such supply extends above the first stage. The pressure of the column of liquefied gas above the first stage ensures that no cavitation will develop in the region of the impeller of the first pump stage.

In many instances, the centrifugal pump of an apparatus for conveying a liquefied gas is an upright pump wherein the first stage is located at the lower end of the pump housing. As a rule, the apparatus consititutes a so-called barrel pump or can pump wherein the barrel or can is a vessel which receives the lower portion of the pump housing. The utilization of a barrel pump or can pump for conveying a liquefied gas brings about certain other problems which still await a satisfactory solution. Thus, the pump shaft is located in the interior of the standpipe which, in turn, renders it necessary to design the shaft seal at the upper end of the pump housing in such a way that the seal will operate properly in spite of the fact that the pressure at the outer side of the seal equals atmospheric pressure but the pressure at the inner side of the seal can reach the maximum pressure of the pumped fluid medium. This is the reason for the utilization of mechanical shaft seals. If the maximum pressure of the conveyed medium is very high and/or if the mechanical seal is operated with a sealing liquid which should be prevented from contaminating the conveyed medium, it is necessary to ensure that the mechanical seal will be contacted only by the gaseous phase but is invariably kept out of contact with the liquefied gas. Attempts to accomplish this include the provision of complex flow restrictors and large expansion chambers for liquefied gas downstream of the flow restrictors. Expansion of the liquid phase in a large chamber entails its conversion into the gaseous phase. Each expansion chamber must be connected with a space wherein the pressure is relatively low so that it can receive the large quantity of gaseous phase which develops in the expansion chamber. The need for large expansion chambers has prevented this proposal from gaining acceptance in the relevant industries, such as refineries, natural gas plants and certain others. Attempts to admit the gaseous phase into the inlet of the centrifugal pump have failed in view of the large quantities of gases. The proposal to admit the gaseous phase into the vessel for the pump housing is not acceptable because it renders it necessary to provide a large number of pipes which contribute significantly to the initial and maintenance cost.

In accordance with another prior proposal, the direction of flow of conveyed medium through the barrel pump is reversed. The pump is installed in the lower part of the vessel and receives liquefied gas through a downwardly extending conduit. The liquefied gas is boiling at the locus of entry into the centrifugal pump and, therefore, it presents no problems to ensure that the shaft seal is contacted only by a gaseous phase. However, the pressurized liquefied gas which issues from the centrifugal pump must enter the vessel which, therefore, must be designed to stand the elevated pressure of the pumped liquefied gas. This renders it necessary to employ high-quality materials and to increase the bulk and weight of the vessel beyond acceptable levels. An additional problem in connection with the utilization of such apparatus is that the bearings which are immersed in liquefied gas are continuously contacted by a boiling fluid which prevents adequate lubrication. Improper maintenance of bearings entails vibrations of the rotor and of the conduit which admits a descending column of liquefied gas into the first stage of the centrifugal pump. Such vibrations lead to cracking of the material and to outright breakage of the respective parts which, in turn, entails a slowdown or complete stoppage of the plant.

OBJECTS AND SUMMARY OF THE INVENTION

An object of the invention is to provide a novel and improved apparatus for pumping liquefied gases which is constructed and assembled in such a way that the liquefied medium is kept out of contact with the shaft seal in a simple, efficient and inexpensive way.

Another object of the invention is to provide an apparatus wherein the means for preventing liquefied gases from contacting the shaft seal occupies little room and contributes little to the bulk of the pump housing.

A further object of the invention is to provide an apparatus wherein the quantity of gaseous phase which develops as a result of prevention of contact between the shaft seal and the liquefied gas is a small fraction of such phase in a conventional apparatus.

An additional object of the invention is to provide a plant which embodies the above outlined apparatus.

Still another object of the invention is to provide the apparatus with novel and improved means for evacuating the gaseous phase from the region of the shaft seal.

A further object of the invention is to provide the apparatus with novel and improved means for preventing contamination of liquefied gas by the sealing liquid which is or can be used in conjunction with the shaft seal.

An additional object of the invention is to provide a novel and improved centrifugal pump which can be used in the above outlined apparatus.

A further object of the invention is to provide novel and improved means for ensuring stepwise expansion of liquefied gas between the last stage of the pump and the shaft seal.

Another object of the invention is to provide a novel and improved distribution of stages in a multi-stage pump which can be used in the above outllined apparatus.

Another object of the invention is to provide a novel and improved method of pumping liquefied gases.

One feature of the invention resides in the provision of an apparatus for conveying a liquefied gas. The apparatus comprises a vessel (e.g., a barrel or a can) which serves to contain a supply of liquefied gas and has an inlet and an outlet, and a centrifugal pump which serves to force the liquefied gas to flow from the inlet to the outlet and to issue from the outlet at an elevated pressure. The pump comprises a plurality of stages including a first and a last stage, and at least the first stage is immersed in the supply of liquefied gas in the vessel. The pump includes a housing, a shaft which is rotatably journalled in the housing, and a rotary mechanical seal between the shaft and the housing. The housing has an expansion chamber for liquefied gas between the last stage and the shaft seal, a first flow restrictor between the last stage and the expansion chamber, a gas collecting chamber for the gaseous phase of liquefied gas between the expansion chamber and the seal, and a second flow restrictor which is disposed between the two chambers and is designed to prevent penetration of liquefied gas from the expansion chamber into the gas collecting chamber.

The housing of the centrifugal pump can further comprise a third chamber which is disposed between the gas collecting chamber and the seal and has means (e.g., one or more conduits) for evacuation of its contents, particularly of sealing liquid if such liquid is used in conjunction with the shaft seal.

Still further, the apparatus can comprise an additional chamber wherein the pressure is lower than in the collecting chamber, and means for connecting the collecting chamber with such additional chamber. For example, the additional chamber can be defined by the vessel and serves to receive the gaseous phase from the collecting chamber.

The first flow restrictor can comprise a piston which surrounds the shaft, and means (such as a portion of the pump housing adjacent the piston) defining with the piston a clearance which connects the last stage of the pump with the expansion chamber so that the expansion chamber is normally filled with liquefied gas. Such filling of the expansion chamber with liquefied gas can be further ensured by the provision of means for admitting liquefied gas into the expansion chamber along a path other than by way of the first flow restrictor. The admitting means is arranged to maintain the pressure of liquefied gas therein at a value exceeding that in the expansion chamber. For example, the liquid admitting means can comprise a system of pipes, bores, channels or like passages which connect the expansion chamber with the second and/or third stages of the centrifugal pump.

The second flow restrictor can define a substantially helical path for the flow of fluids between the expansion chamber and the gas collecting chamber. To this end, the shaft can be provided with an external thread which defines the helical path and serves to convey liquefied gas along the helical path in a direction from the collecting chamber toward the expansion chamber when the shaft is rotated to drive the impellers of the centrifugal pump. Alternatively or in addition to the just discussed external thread, the second flow restrictor can comprise a centripetal impeller which serves to convey liquefied gas in a direction from the collecting chamber toward the expansion chamber so that the collecting chamber receives only a relatively small quantity of gaseous phase, e.g., that which develops as a result of boiling of liquefied gas at the upper level of the column of liquefied gas in the second flow restrictor.

In order to further ensure that the collecting chamber will contain only the gaseous phase of conveyed fluid medium, the pump can be equipped with means for heating the contents of the collecting chamber. Such heating means can comprise one or more heating elements (e.g., suitable heat exchangers) and/or one or more heat transmitting projections (e.g., ribs) which extend into the collecting chamber and/or are provided at the exterior of the pump housing in the region of the collecting chamber and can supply heat for transmission to the contents of the collecting chamber.

The centrifugal pump can constitute an upright pump wherein the first stage is disposed at a level below the other stages. For example, the pump can comprise four stages, and the first and second stages can be connected to each other by a riser or standpipe.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
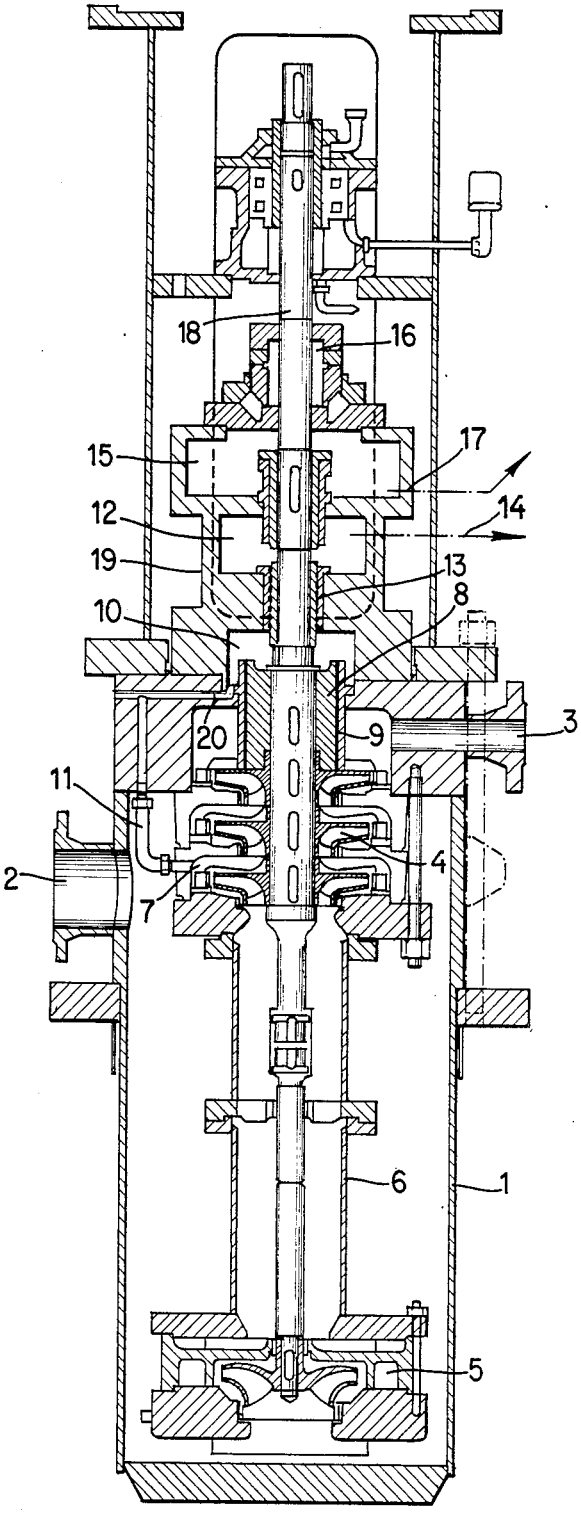
FIG. 1 is a central vertical sectional view of an apparatus which employs a four-stage upright centrifugal pump.

FIG. 1 shows an apparatus wherein an upright multistage centrifugal pump 4 is installed in a vessel 1 (also called can or barrel) having an inlet 2 for admission of liquefied gas and an outlet 3 for evacuation of pressurized liquefied gas. The illustrated pump 4 has four stages including a first or lowermost stage 5 and three additional or higher stages including a second stage 7. The connection between the first and second stages 5, 7 comprises an upright riser or standpipe 6 which surrounds the pump shaft 18. As shown, the first stage 5 is close to the bottom wall of the vessel 1 and is invariably below the level of the supply of liquefied gas in the vessel. The source of liquefied gas which admits the gas to the inlet 2 is not shown in the drawing. The third and fourth stages of the pump 4 are immediately or closely adjacent to each other and to the second stage 7, i.e., there is no need for risers between the second and thrid and/or between the third and fourth stages.

The means for taking up axial thrust is of conventional design and comprises a piston 8 which further constitutes one component of a first flow restrictor. This flow restrictor further comprises the adjacent portion of the pump housing or body 19, and the components 8, 19 define an annular clearance or gap 9 which surrounds the shaft 18 and permits liquefied gas to penetrate from the last stage of the pump 4 into an expansion chamber 10 which surrounds the shaft 18 downstream of the last stage, as considered in a direction toward a rotary mechanical seal 16 between the shaft 18 and the topmost portion of the housing 19. The means for ensuring that the expansion chamber 10 is always filled with liquefied gas comprises one or more bores 20 in the pump housing 19 and a conduit 11. Reference may be had to commonly owned copending patent application Ser. No. 375,001 filed May 5, 1982, now U.S. Pat. No. 4,614,482, whose disclosure is incorporated herein by reference. The connection 11, 20 further ensures that the expansion chamber 10 does not contain a gas which could interfere with the operation of the expansion system between the last stage of the pump 4 and the seal 16.

The expansion chamber 10 is disposed at a level below a gas collecting chamber 12 which surrounds the pump shaft 18 and can communicate with the chamber 10 by way of a helical path defined by an externally threaded portion 13 of the shaft 18. The portion 13 can be a separately produced path which is affixed to the shaft 18 between the chambers 10, 12 and tends to induce a flow of fluid medium from the chamber 12 into the chamber 10 when the shaft 18 is driven by a motor (not shown) so as to rotate the impellers of the pump 4. When the externally threaded portion 13 of the shaft 18 dips into liquefied gas, it generates a pressure which suffices to ensure that liquefied gas cannot penetrate into the collecting chamber 12. The chamber 12 contains only a gas and possibly negligible quantities of liquefied gas. The second flow restrictor including the externally threaded portion 13 and the surrounding portion of the housing 19 performs a self-regulating action due to the fact that the collecting chamber 12 contains only a gaseous fluid. As a rule, the amount of leakage of liquefied gas along the helical path between the externally threaded portion 13 and the adjacent portion of the housing 19 in a direction from the expansion chamber 10 into the collecting chamber 12 is zero or practically zero. The level of liquefied gas in the helical path around the portion 13 of the shaft 18 is determined by the pressure of liquefied gas in the expansion chamber 10. In fact, the quantity of gas which penetrates into the collecting chamber 12 is also small or minimal; the major quantity of gas which enters the collecting chamber 12 develops as a result of boiling at the upper level of the column of liquefied gas in the helical path surrounding the portion 13.

The means for evacuating the surplus of gaseous phase from the collecting chamber 12 comprises a conduit 14 which is open to the atmosphere or discharges the collected surplus of the gaseous phase into the inlet 2, into the upper portion of the vessel 1 or into a gas collecting tank, not shown.

The apparatus can further comprise a third chamber (second expansion chamber) 15 which is disposed between the collecting chamber 12 and the mechanical seal 16 and has an outlet 17 for draining. The mechanical seal 16 is of known design and can be operated with a sealing liquid. Any sealing liquid which leaks into the chamber 15 is evacuated by way of the outlet 17 which is open at intervals or continuously.

An important advantage of the improved apparatus is that it ensures, in a simple but highly reliable way, that liquefied gas cannot reach the shaft seal 16. This apparatus can employ centrifugal pumps wherein axial stresses are taken up by a device including the aforediscussed piston 8 as well as those wherein axial thrust which is generated by the hydraulic fluid is counteracted and is at least substantially compensated for by individually relieving each impeller of axial stresses. The construction which is shown in the drawing is preferred in many instances because the piston 8 can also constitute one component of the (first) flow restrictor between the last stage of the centrifugal pump 4 and the expansion chamber 10.

The advantages of the connection 11, 20 between the expansion chamber 10 and the second stage 7 of the pump 4 were explained above, i.e., this ensures proper operation of the piston 8 because the expansion chamber 10 is invariably filled with liquefied gas which flows from chamber 10 into the second stage 7. The second stage 7 depicts the pressure inside of the chamber 10. It is not always necessary to connect the expansion chamber 10 with the second stage 7; all that counts is to ensure that the connection 11, 20 or an analogous connection establishes a path for the flow of liquefied gas from the chamber location (such as the second or third stage of the pump 4) wherein the pressure exceeds the saturation pressure of the conveyed medium.

The flow restrictor including the externally threaded portion 13 of the shaft 18 ensures that the collecting chamber 12 receives relatively small quantities of gaseous phase such as can be readily evacuated, for example, into the inlet 2, into the upper portion of the vessel 1, into a tank or to any other suitable location to ensure continuous or permanent evacuation of gases from the chamber 12.

Figure 3:
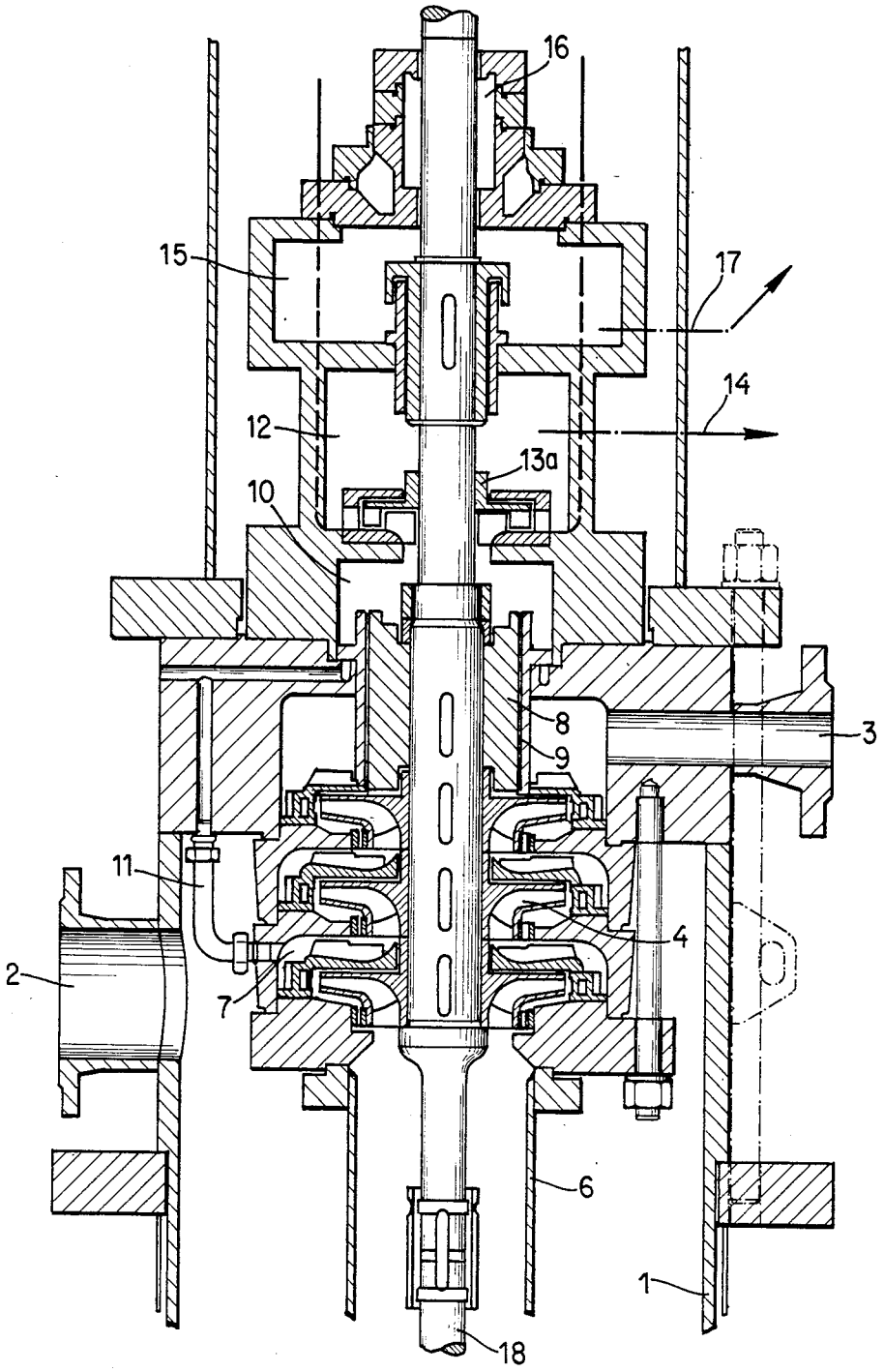
FIG. 3 is similar to FIG. 1, but shows another embodiment of the pump.

The means (13, 19) which defines the helical path designed to urge the liquefied gas to flow in a direction from the chamber 12 into the chamber 10 constitutes but one form of flow restrictor means between the chambers 10 and 12. For example, such flow restrictor means can be replaced by or used jointly with one or more centripetal impellers. FIG. 3 illustrates a centripetal impeller **13*a* which is mounted on the shaft 18 between the chambers 10 and 12. The impeller 13*a* is designed such that, when the shaft 18 rotates, the impeller 13*a* forces fluid in a direction from the collecting chamber 12 towards the expansion chamber 10**.

Figure 2:
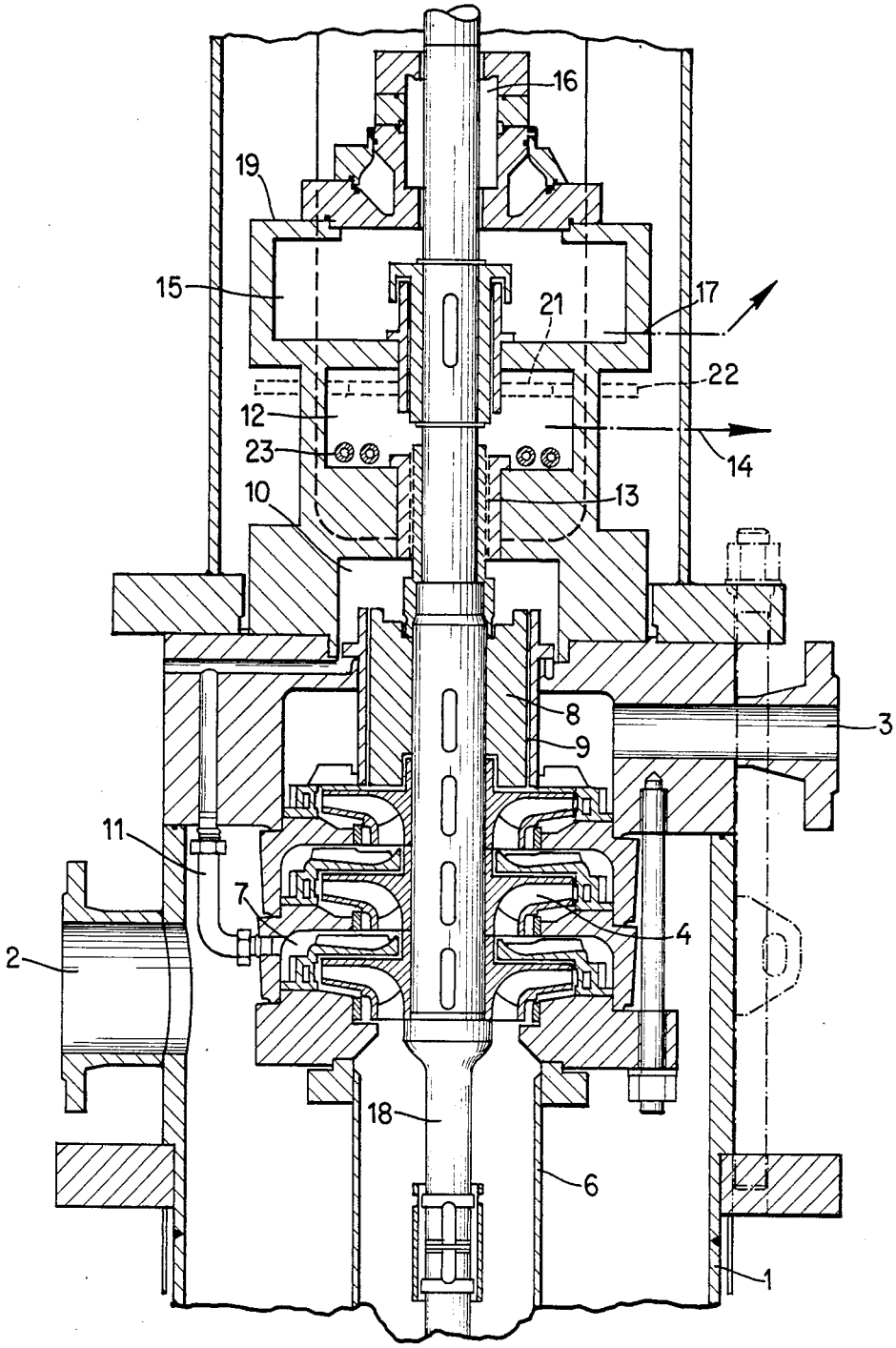
FIG. 2 is an enlarged view of a detail in the apparatus of FIG. 1.

In order to ensure that the collecting chamber 12 will receive or contain only a gaseous phase, even under the most adverse circumstances, the apparatus can be further provided with means (FIG. 2) for heating the contents of the chamber 12. For example, the housing 19 can be provided with one or more internal ribs 21 (one shown by broken lines) which extend into the collecting chamber 12 to heat its contents. Alternatively, or in addition to the internal rib 21, the housing 19 can be provided with one or more external ribs 22 (one shown by broken lines) to deliver heat which ensures that liquefied gas entering the chamber 12 is converted into a gaseous phase. Still further, the apparatus can be equipped with one or more heating elements 23 in the chamber 12 and/or in the housing 19 adjacent the chamber 12 to ensure adequate heating of the contents of this chamber. The heating element or elements (which may be of any known design) can be used in addition to or in lieu of the rib or ribs 21 and/or 22.

It is further within the purview of the invention to employ two or more centrifugal pumps which are placed into a common vessel and are installed therein in upright position or in horizontal position. The helical path can be defined by an internally threaded portion of the housing 19.

A shaft seal which is manufactured by the assignee of the present application is disclosed in commonly owned U.S. Pat. No. 4,146,238 granted Mar. 27, 1979 to Karl Gaffal.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for conveying liquefied gases, comprising a vessel arranged to contain a supply of liquefied gas and having an inlet and an outlet; and a centrifugal pump arranged to pump the liquefied gas from said inlet to said outlet and having a plurality of stages including a first and a last stage, at least said first stage being immersed in the supply of liquefied gas in said vessel, said pump including a housing, a shaft rotatably journalled in said housing and a seal between said shaft and said housing, said housing having an expansion chamber for liquefied gas between said last stage and said seal, a first flow restrictor between said last stage and said chamber, a gas collecting chamber for the gaseous phase of liquefied gas between said expansion chamber and said seal, and a second flow restrictor disposed between said chambers and arranged to urge liquefied gas in a direction from said collecting chamber towards said expansion chamber.

2. The apparatus of claim 1, wherein said housing further comprises a third chamber disposed between said collecting chamber and said seal and having outlet means for evacuation of its contents.

3. The apparatus of claim 1, further comprising an additional chamber wherein the pressure is lower than in said collecting chamber, and means for connecting said collecting chamber with said additional chamber.

4. The apparatus of claim 3, wherein said additional chamber is defined by said vessel.

5. The apparatus of claim 1, wherein said first flow restrictor comprises a piston surrounding said shaft and means defining with said piston a clearance connecting said last stage with said expansion chamber so that the expansion chamber is normally filled with liquefied gas.

6. The apparatus of claim 5, further comprising means for admitting liquefied gas into said expansion chamber, said admitting means being arranged to maintain the pressure of liquefied gas therein at a pressure exceeding that in said expansion chamber.

7. The apparatus of claim 1, wherein said second flow restrictor defines a substantially helical path for penetration thereinto of liquefied gas from said expansion chamber.

8. The apparatus of claim 7, wherein said shaft has an external thread which defines said helical path and is arranged to convey liquefied gas along said path in a direction from said collecting chamber toward said expansion chamber in response to rotation of said shaft.

9. The apparatus of claim 1, wherein said second flow restrictor includes at least one centripetal impeller arranged to convey liquefied gas in a direction from said collecting chamber toward said expansion chamber in response to rotation of said shaft.

10. The apparatus of claim 1, further comprising means for heating the contents of said collecting chamber.

11. The apparatus of claim 10, wherein said heating means comprises at least one heat dissipating projection provided in said housing and extending into said collecting chamber.

12. The apparatus of claim 10, wherein said heating means comprises at least one external projection provided on said housing in the region of said collecting chamber.

13. The apparatus of claim 10, wherein said heating means comprises at least one rib on said housing.

14. The apparatus of claim 10, wherein said heating means comprises at least one heating element, particularly a heat exchanger, in said collecting chamber.

15. The apparatus of claim 1, wherein said pump has more than three stages including a second stage and comprises a riser between said first stage and said second stage.

16. The apparatus of claim 1, further comprising means for connecting said collecting chamber with a space having a pressure lower than the vapor pressure of the liquefied gas.

17. A centrifugal pump, comprising a housing; a shaft rotatably journalled in said housing; an impeller mounted on said shaft for rotation therewith; a seal between said shaft and said housing, said housing having an expansion chamber between said impeller and said seal and a gas collecting chamber between said expansion chamber and said seal; a first flow restrictor between said impeller and said expansion chamber; and a second flow restrictor between said expansion chamber and said collecting chamber, said second flow restrictor being designed to urge fluid in a direction from said collecting chamber towards said expansion chmber.

18. Apparatus for conveying liquefied gases, comprising a vessel arranged to contain a supply of liquefied gas and having an inlet and an outlet; and a centrifugal pump arranged to pump the liquefied gas from said inlet to said outlet and having a plurality of stages including a first and a last stage, at least said first stage being immersed in the supply of liquefied gas in said vessel, said pump including a housing, a shaft rotatably journalled in said housing and a seal between said shaft and said housing, said housing having an expansion chamber for liquefied gas between said last stage and said seal, a first flow restrictor between said last stage and said chamber, a gas collecting chamber for the gaseous phase of liquefied gas between said expansion chamber and said seal, and a second flow restrictor disposed between said chambers and arranged to prevent penetration of liquefied gas from said expansion chamber into said collecting chamber, said first flow restrictor comprising a piston surrounding said shaft and means defining with said piston a clearance connecting said last stage with said expansion chamber so that the expansion chamber is normally filled with liquefied gas, said pump further comprising means for admitting liquefied gas into said expansion chamber and said admitting means being arranged to maintain the pressure of liquefied gas therein at a pressure exceeding that in said expansion chamber, said pump including second and third stages and said admitting means comprising at least one of said second and third stages.

* * * * *